US009587193B2

(12) United States Patent
Arondel et al.

(10) Patent No.: US 9,587,193 B2
(45) Date of Patent: Mar. 7, 2017

(54) ADDITIVES FOR IMPROVING THE RESISTANCE TO WEAR AND TO LACQUERING OF DIESEL OR BIODIESEL FUELS

(71) Applicant: TOTAL MARKETING SERVICES, Puteaux (FR)

(72) Inventors: Mathieu Arondel, Courbevoie (FR); Thomas Dubois, Lyons (FR); Laurent Germanaud, Heyrieux (FR); Hélène Rodeschini, Moins (FR)

(73) Assignee: Total Marketing Services, Putcaux (FR)

( * ) Notice: Subject to any disclaimer, the term of this patent is extended or adjusted under 35 U.S.C. 154(b) by 59 days.

(21) Appl. No.: 14/378,384

(22) PCT Filed: Feb. 15, 2013

(86) PCT No.: PCT/EP2013/053049
§ 371 (c)(1),
(2) Date: Aug. 13, 2014

(87) PCT Pub. No.: WO2013/120985
PCT Pub. Date: Apr. 22, 2013

(65) Prior Publication Data

US 2016/0024411 A1 Jan. 28, 2016

(30) Foreign Application Priority Data

Feb. 17, 2012 (FR) ..... 12 51512

(51) Int. Cl.
*C10L 1/18* (2006.01)
*C10L 10/04* (2006.01)
(Continued)

(52) U.S. Cl.
CPC ..... *C10L 10/04* (2013.01); *C10L 1/143* (2013.01); *C10L 1/18* (2013.01); *C10L 1/191* (2013.01);
(Continued)

(58) Field of Classification Search
CPC ..... C10L 10/04; C10L 10/08; C10L 10/00; C10L 1/1985; C10L 1/143; C10L 1/191; C10L 1/18; C10L 1/22
See application file for complete search history.

(56) References Cited

U.S. PATENT DOCUMENTS 3,219,666 A 11/1965 Norman et al.
3,329,658 A 7/1967 Fields
(Continued)

FOREIGN PATENT DOCUMENTS

CA 2145168 A1 3/1994
CA 2154344 A1 8/1994
(Continued)

OTHER PUBLICATIONS

Ziejewski, Mariusz, et al.: "Reduced Injection Needle Mobility Caused by Lacquer Deposits from Sunflower Oil," 880493, SAE—The Engineering Society for Advancing Mobility Land Sea Air and Space, International Congress and Exposition, Detroit, Michigan, Feb. 29-Mar. 4, 1988; 12 pages.
(Continued)

*Primary Examiner* — Cephia D Toomer
(74) *Attorney, Agent, or Firm* — Harness, Dickey & Pierce, P.L.C.

(57) ABSTRACT

The present disclosure relates to novel anti-wear additives for diesel or biodiesel fuels having a sulphur content less than or equal to 500 ppm by mass. These novel additives will also improve the lacquering resistance of the higher-grade
(Continued)

Distribution of percentage areas to be assessed diesel or biodiesel fuels having a sulphur content less than or equal to 500 ppm by mass.

20 Claims, 1 Drawing Sheet

(51) Int. Cl.

| | |
|---|---|
| ***C10L 10/08*** | (2006.01) |
| ***C10L 1/198*** | (2006.01) |
| ***C10L 1/14*** | (2006.01) |
| ***C10L 1/19*** | (2006.01) |
| ***C10L 10/00*** | (2006.01) |
| ***C10L 1/22*** | (2006.01) |
| *C10L 1/188* | (2006.01) |
| *C10L 1/224* | (2006.01) |
| *C10L 1/238* | (2006.01) |
| *C10L 1/2383* | (2006.01) |
| *C10L 10/18* | (2006.01) |

(52) U.S. Cl.

CPC ..... *C10L 1/1985* (2013.01); *C10L 1/22* (2013.01); *C10L 10/00* (2013.01); *C10L 10/08* (2013.01); *C10L 1/1883* (2013.01); *C10L 1/1888* (2013.01); *C10L 1/19* (2013.01); *C10L 1/198* (2013.01); *C10L 1/1915* (2013.01); *C10L 1/224* (2013.01); *C10L 1/238* (2013.01); *C10L 1/2383* (2013.01); *C10L 10/18* (2013.01); *C10L 2200/0259* (2013.01); *C10L 2200/0446* (2013.01); *C10L 2200/0476* (2013.01); *C10L 2270/023* (2013.01); *C10L 2270/026* (2013.01)

(56) References Cited

U.S. PATENT DOCUMENTS

| | | | | |
|---|---|---|---|---|
| 3,346,354 | A * | 10/1967 | Kautsky | C10L 1/198 44/351 |
| 3,565,804 | A | 2/1971 | Honnen et al. | |
| 3,702,300 | A | 11/1972 | Coleman | |
| 4,511,369 | A | 4/1985 | Denis et al. | |
| 4,652,273 | A | 3/1987 | Maldonado et al. | |
| 4,664,676 | A | 5/1987 | Denis et al. | |
| 4,731,095 | A | 3/1988 | Garapon et al. | |
| 4,900,332 | A | 2/1990 | Denis et al. | |
| 5,106,515 | A | 4/1992 | Denis et al. | |
| 5,256,740 | A | 10/1993 | Denis et al. | |
| 5,449,386 | A | 9/1995 | Denis et al. | |
| 5,456,730 | A | 10/1995 | Hart et al. | |
| 5,632,785 | A | 5/1997 | Culotta | |
| 5,697,988 | A | 12/1997 | Malfer et al. | |
| 5,730,029 | A | 3/1998 | Stoldt et al. | |
| 5,998,530 | A | 12/1999 | Krull et al. | |
| 6,071,318 | A | 6/2000 | Mallet et al. | |
| 6,083,287 | A | 7/2000 | Germanaud et al. | |
| 6,096,104 | A | 8/2000 | Van den Neste et al. | |
| 6,511,520 | B1 | 1/2003 | Eber et al. | |
| 7,374,589 | B2 | 5/2008 | Bernasconi et al. | |
| 7,947,241 | B2 | 5/2011 | Schmelzle et al. | |
| 8,097,570 | B2 | 1/2012 | Boitout et al. | |
| 8,334,245 | B2 | 12/2012 | Lancon et al. | |
| 8,349,033 | B2 * | 1/2013 | Muth | C10L 1/143 44/389 |
| 8,409,304 | B2 | 4/2013 | Furuta et al. | |
| 8,664,169 | B2 | 3/2014 | Bouffet | |
| 2005/0223631 | A1 | 10/2005 | Jackson | |
| 2008/0060259 | A1 | 3/2008 | Breakspear et al. | |
| 2008/0295394 | A1 | 12/2008 | Furuta et al. | |
| 2009/0282731 | A1 | 11/2009 | Malfer et al. | |
| 2009/0288988 | A1 | 11/2009 | Mayeur et al. | |
| 2010/0015022 | A1 | 1/2010 | Schmelzle et al. | |
| 2010/0275508 | A1 | 11/2010 | Dolmazon et al. | |
| 2010/0281762 | A1 | 11/2010 | Chevrot et al. | |
| 2011/0092403 | A1 | 4/2011 | Lancon et al. | |
| 2011/0306526 | A1 | 12/2011 | Germanaud et al. | |
| 2012/0010112 | A1 | 1/2012 | Grabarse et al. | |
| 2012/0102825 | A1 | 5/2012 | Chevrot et al. | |
| 2012/0216452 | A1 | 8/2012 | Furuta et al. | |
| 2013/0255139 | A1 | 10/2013 | Dolmazon et al. | |
| 2014/0157655 | A1 | 6/2014 | Tort et al. | |

FOREIGN PATENT DOCUMENTS

| | | | |
|---|---|---|---|
| CA | 2223653 | A1 | 2/1997 |
| DE | 102004055589 | A1 | 5/2006 |
| EP | 0261959 | A2 | 3/1988 |
| EP | 0271385 | A1 | 6/1988 |
| EP | 0826765 | A1 | 3/1998 |
| EP | 1679300 | A1 | 7/2006 |
| EP | 1884556 | A2 | 2/2008 |
| FR | 2528423 | A1 | 12/1983 |
| FR | 2772783 | A1 | 6/1999 |
| GB | 2121808 | A | 1/1984 |
| WO | WO-9314178 | A1 | 7/1993 |
| WO | WO-9413758 | A1 | 6/1994 |
| WO | WO-9804656 | A1 | 2/1998 |
| WO | WO-2005023965 | A1 | 3/2005 |
| WO | WO2006053664 | * | 5/2006 |
| WO | WO-2009040582 | A1 | 4/2009 |
| WO | WO-2010097624 | A1 | 9/2010 |
| WO | WO-2010132259 | A1 | 11/2010 |
| WO | WO-2011134923 | A1 | 11/2011 |
| WO | WO-2012152309 | A1 | 11/2012 |

OTHER PUBLICATIONS

Ullmann, Jorg, et al.: "Investigation into the Formation and Prevention of Internal Diesel Injector Deposits," 2008-1-0926, SAE Technical Paper Series—2008 World Congress, Detroit, Michigan, Apr. 14-17, 2008, 12 pages.

Caprotti, Rinaldo, et al.: "Deposit Control in Modern Diesel Fuel Injection Systems," 2010-01-2250; SAE Int. J. Fuels Lubr., vol. 3, Issue 2, Oct. 25, 2010, pp. 901-915.

Schwab, Scott D., et al.: "Internal Injector Deposits in High-Pressure Common Rail Diesel Engines," 2010-1-2242; SAE Int. J. Fuels Lubr., vol. 3, Issue 2, Oct. 25, 2010; pp. 865-878.

Surfactants for Industrial Applications—Clariant: Nonionic and Anionic Emulsifiers, Copolymerizable Surfactants, Dispersing Agents and Defoamers, Jul. 5, 2010, XP055057096, URL:http://web.archive.org/web/20100705090559/http://www.hui.edu.vn/khoahoa/data/files/SACH THAM KHAO CHDBM/Surfactants_for_Industrial_Applications.pdf [retrieved from internet on Mar. 19, 2013], 24 pages.

* cited by examiner

Distribution of percentage areas to be assessed
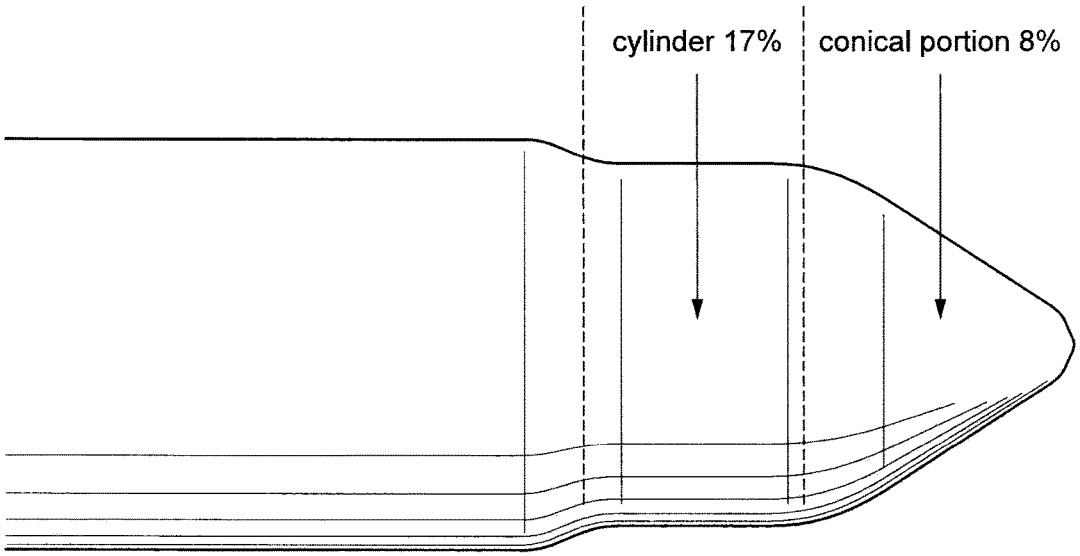

ADDITIVES FOR IMPROVING THE RESISTANCE TO WEAR AND TO LACQUERING OF DIESEL OR BIODIESEL FUELS

CROSS-REFERENCE TO RELATED APPLICATIONS

This application is a National Phase Entry of International Application Serial No. PCT/EP2013/053049, filed on Feb. 15, 2013, which claims priority to French Patent Application Serial No. 1251512, filed on Feb. 17, 2012, both of which are incorporated by reference herein.

BACKGROUND AND SUMMARY

A subject of the present invention is additives intended to improve the wear resistance and the lubricity of diesel or biodiesel fuels but also their lacquering resistance. The present invention also relates to the use of additive compositions for improving the lacquering resistance of higher-grade (bio)dieselfuels.

In many countries the sulphur content of diesel (B0) or biodiesel (Bx) fuels has been subject to a reduction for environmental reasons, in particular in order to reduce the $SO_2$ emissions. For example in Europe, the maximum sulphur content of road diesel fuels is currently 10 ppm by mass.

As well as reducing the sulphur content, the methods of preparation of low-sulphur diesel fuel bases, for example hydrotreatment methods, also reduce the polycyclic aromatic compounds and polar compounds contained in these fuel bases. It is known that diesel fuels having a low (less than 100 ppm by mass) or very low sulphur content have a reduced ability to lubricate the engine fuel injection system, which results for example in early failure of the engine fuel injection pump during the lifetime of the engine, failure occurring for example in high-pressure fuel injection systems, such as high-pressure rotary distributors, in-line pumps, combined pump-injector units and injectors.

Lubrication and/or anti-wear additives for fuel oils have been described in EP 680506; these additives include a carboxylic acid ester and an alcohol, in which the acid has from 2 to 50 carbon atoms, and the alcohol has one or more atoms; one of the preferred additives is glycerol monooleate (GMO). EP 839174 describes lubricant additives comprising:

a) an ester obtained by reacting an unsaturated monocarboxylic acid and a polyhydroxylated alcohol b) an ester obtained by reacting an unsaturated monocarboxylic acid and a polyhydroxylated alcohol having at least 3 hydroxy groups, the esters a) and b) being different. Apart from their lubricant properties, these mixtures of esters have a particularly good filterability (measured according to standard IP 387); the preferred mixtures of esters are the mixtures mainly comprising glycerol monooleate and glycerol monolinoleate, preferably in substantially equal proportions.

EP 915944 describes anti-wear additives for low-sulphur diesel fuels constituted by a combination of at least one monocarboxylic aliphatic hydrocarbon, saturated or unsaturated, with a linear chain comprised between 12 and 24 carbon atoms and at least one polycyclic hydrocarbon compound chosen from the group constituted by the natural resin acids, and derivatives of carboxylates of amines, esters and nitriles of these acids. These additives can for example be derived from "tall oil". However, the diesel fuels and in particular the higher-grade fuels to which these anti-wear additives have been added are sometimes found to have unsatisfactory lacquering-resistance properties.

Diesel fuels on the market must meet national or supranational specifications (for example standard EN 590 for diesel fuels in the EU). For commercial fuels, there is no legal obligation regarding the incorporation of additives (chemical compounds incorporated in fuels to improve their properties, for example additives for improving low temperature resistance); the oil companies and the distributors are free to add or not add additives to their fuels. From the commercial standpoint, in the field of distribution of fuels, a distinction is made between the "lowest price fuels", with little or no additives, and higher-grade fuels, in which one or more additives are incorporated to improve their performance (above the regulation performance). Within the meaning of the present invention, by higher-grade diesel fuel or bio diesel fuel is meant any diesel or biodiesel to which at least 50 ppm by mass of at least one component chosen from deposit reducers, detergents, dispersants has been added. Diesel fuels of the B0 type, which do not contain an oxygen-containing component are distinguished from biodiesel fuels of the Bx type which contain x % (v/v) vegetable oil esters or fatty acids, more usually methyl esters (FAME or VOME).

It has been noted that some higher-grade diesel or biodiesel fuels sometimes cause deposits on the injector needles of injection systems of diesel engines, in particular those of Euro 3 to Euro 6 type. This phenomenon of deposits is also known by the term lacquering, which will be used hereinafter, or the acronym IDID (internal diesel injector deposits). Within the meaning of the present invention, the lacquering phenomenon does not refer to deposits outside of the injection system relating to the coking or fouling of injection nozzles as simulated for example by the standard engine test CEC F098-08 DW10B, especially when the fuel tested is contaminated with metallic zinc.

The lacquering phenomenon can be localized on the end of the injector needles, both on the head and on the body of the needles of the fuel injection system but also throughout the system controlling the needle lift (valves) of the injection system, for vehicle engines operating on diesel or biodiesel fuel, and in particular for higher-grade (bio)diesel fuels. This lacquering phenomenon can eventually generate a loss of flow rate of fuel injected and therefore a loss of engine power.

Generally a distinction is made between 2 types of deposits of the lacquering type:

1. deposits that are rather whitish and powdery; on analysis, it is found that these deposits consist essentially of soaps of sodium (sodium carboxylate, for example) and/or of calcium (type 1 deposits);

2. organic deposits resembling coloured varnishes localized on the needle body (type 2 deposits).

Regarding the type 1 deposits, there are many possible sources of sodium in biodiesel fuels of the Bx type:

catalysts for transesterification of vegetable oils for producing esters of the fatty acid (m)ethyl ester type such as sodium formate;

another possible source of sodium can originate from the corrosion inhibitors used when petroleum products are conveyed in certain pipes, such as sodium nitrite;

finally, accidental exogenous pollution, via water or air for example, can contribute to the introduction of sodium into fuels (sodium being a very wide occurring element).

There are many possible sources of acids in fuels of the Bx type, for example:

- residual acids in biofuels (see standard EN14214 which stipulates a maximum permitted level of acids)
- corrosion inhibitors used in the conveyance of petroleum products in certain pipes such as DDSA (dodecenylsuccinic anhydride) or HDSA (hexadecenylsuccinic anhydride) or some of their functional derivatives such as acids.

With regard to type 2 organic deposits, some publications state that they may in particular result from reactions between deposit reducers/dispersants (for example of the polyisobutylenesuccinimide (PIBSI) type) and acids (which would be present inter alia as impurities of esters of fatty acids in biodiesel). In the publication SAE 880493, *Reduced Injection Needle Mobility Caused by Lacquer Deposits from Sunflower Oil*, the authors M Ziejewski and H J Goettler describe the lacquering phenomenon and its harmful consequences for the operation of engines operating with sunflower oils as fuel. In the publication SAE 2008-01-0926, *Investigation into the Formation and Prevention of Internal Diesel Injector Deposits*, the authors J Ullmann, M Geduldig, H Stutzenberger (Robert Bosch GmbH) and R Caprotti, G Balfour (Infineum) also describe the reactions between acids and deposit reducers/dispersants to explain the type 2 deposits.

Furthermore, in the publication SAE International, 2010-01-2242, *Internal Injector Deposits in High-Pressure Common Rail Diesel Engines*, the authors S. Schwab et al explain that the internal parts of the injectors are generally covered with a slightly coloured deposit that is visible to the naked eye. Their analyses showed that it mainly comprises sodium salts of alkenyl (hexadecenyl or dodecenyl) succinic acids; the sodium originating from dehydrating agents, from caustic solutions used in the refinery, from tank bottom water or from seawater, and the succinic diacids being used as corrosion inhibitors or present in multifunctional additive packages. Once formed, these salts are insoluble in low-sulphur diesel fuels, and as they are in the form of fine particles they pass through diesel filters and are deposited inside the injectors. In this publication, the development of an engine test is described, making it possible to reproduce the deposits. This publication emphasizes that only the diacids generate deposits, in contrast to monocarboxylic acids or the neutral esters of organic acids.

In the publication SAE International, 2010-01-2250, *Deposit Control in Modern Diesel Fuel Injection System*, the authors, R. Caprotti, N. Bhatti and G. Balfour, also investigate the same type of internal deposits in the injectors and assert that the appearance of deposits is not linked specifically to one type of fuel (B0 or containing FAME(Bx)) nor to vehicles of one type (light vehicles or heavy goods vehicles) equipped with modern types of engines (common rail). They demonstrate the performance of a new deposit reducer/dispersant, effective on all types of deposits (coking and lacquering).

The document DE 10 2004 055589 describes esters obtained from carboxylic acids comprising from 11 to 21 carbon atoms and diglycerol, oligoglycerols and/or polyglycerols. These esters are used for improving the lubricity of diesel fuel. This document does not relate to improving the lacquering resistance of fuels of higher-grade (bio)diesel type.

The deposits due to the lacquering phenomenon are insoluble in low-sulphur diesel fuels and in biodiesel fuels. These deposits are in the form of fine particles and can pass through diesel filters and can then be deposited inside the injectors. The accumulation of deposits of the lacquering type as described above can lead to the following problems:

- a slowing of the response of the fuel injector,
- sticking of internal components, which can lead to a loss of control of injection time as well as of the amount of fuel supplied per injection,
- a loss of manoeuvrability of the vehicle,
- variations in power,
- an increase in fuel consumption,
- an increase in pollutants,
- a disturbance in combustion, since the amount of fuel injected will not be that envisaged theoretically and the injection profile will be different,
- an unstable idle of the vehicle,
- an increase in engine noise,
- a lowering of the quality of combustion over the long term,
- a lowering of the quality of atomization.

If there is a heavy deposit of the lacquering type, the vehicle could have great difficulty starting, or even not start at all, since the needle permitting injection would be blocked.

The present invention makes it possible to overcome the problems indicated above. The present invention proposes additives capable of really improving not only the wear resistance of (bio)diesel fuels having a low sulphur content, typically less than 100 ppm by mass, but also the lacquering resistance of higher-grade (bio)diesel fuels, i.e. containing as additives at least 50 ppm by mass of at least one component chosen from deposit reducers, detergents, dispersants.

DETAILED DESCRIPTION

The present invention also relates to the use of additive compositions for improving the lacquering resistance of higher-grade (bio)diesel fuels, said additives comprising at least 50% by mass of polyglycerol monoester(s) and/or diester(s), said polyglycerols having from 2 to 5 glycerol units per molecule and the ester units being fatty acid derivatives, the fatty acid(s) optionally having one or more ethylenic unsaturations, and more than 50% by number of fatty chains comprising between 12 and 24 carbon atoms. Within the meaning of the present invention, by higher-grade diesel or biodiesel fuel is meant any diesel or biodiesel, in which are incorporated one or more additives for improving the performances thereof (beyond the regulatory performances), preferably, any diesel or biodiesel fuel containing as additive at least 50 ppm by mass of at least one component chosen from deposit reducers, detergents, dispersants.

According to a embodiment, the detergent or dispersant additives are in particular (but non-limitatively) chosen from the group constituted by the amines, succinimides, succinamides, alkenylsuccinimides, polyalkylamines, polyalkyl polyamines, polyetheramines, Mannich bases; examples of such additives are given in EP 938535. According to a particular preferred embodiment, the deposit reducer/detergent/dispersant is chosen from:

- substituted succinic acid anhydrides, in particular polyisobutenyl succinic anhydrides, often called PIBSA, in which the polyisobutylene group (also called polyisobutene) has a molecular mass comprised between 140 and 5000 and preferably between 500 and 2000 or preferably between 750 and 1250,
- substituted amines such as N-polyisobutene amine R1-NH2, N-polyisobutene-ethylenediamine R1-NH—R2-NH2, or also polyisobutene succinimides of formula:

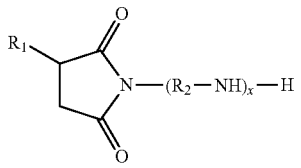

where R represents a polyisobutene (polyisobutylene) group of molecular weight comprised between 140 and 5000 and preferably between 500 and 2000 or preferably between 750 and 1250; or their bis-succinimide, succinnamic, succinamide structural equivalents, and where R2 represents at least one of the following segments –CH2-CH2-, CH2-CH2-CH2, –CH2-CH(CH3)- and x represents an integer comprised between 1 and 6, polyethylene amines. These are particularly effective. They are described for example in detail in the reference "Ethylene Amines" Encyclopedia of Chemical Technology, Kirk and Othmer, Vol. 5, pp. 898-905, Interscience Publishers, New York (1950).

polyether amines of formula:

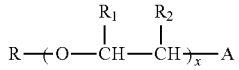

where R is an alkyl or aryl group having from 1 to 30 carbon atoms; R1 and R2 are each independently a hydrogen atom, an alkyl chain with 1 to 6 carbon atoms or —O—CHR1-CHR2-; A is an amine or N-alkylamine with 1 to 20 carbon atoms in the alkyl chain, an N,N-dialkylamine having from 1 to 20 carbon atoms in each alkyl group, or a polyamine with 2 to 12 nitrogen atoms and from 2 to 40 carbon atoms and x is in the range from 5 to 30.

Such polyetheramines are marketed for example by the companies BASF, HUNTSMAN or CHEVRON.

the products of reaction between a phenol substituted with a hydrocarbon chain, an aldehyde and an amine or polyamine or ammonia. The alkyl group of the alkylated phenol can comprise from 10 to 110 carbon atoms. This alkyl group can be obtained by polymerization of olefinic monomer containing from 1 to 10 carbon atoms (ethylene; propylene; 1-butene, isobutylene and 1-decene). The polyolefins that are used in particular are polyisobutene and/or polypropylene. The polyolefins generally have a weight-average molecular weight Mw between 140 and 5000 and preferably between 500 and 2000 or preferably between 750 and 1250.

The alkyl phenols can be prepared by an alkylation reaction between a phenol and an olefin or a polyolefin such as polyisobutylene or polypropylene. The aldehyde used can contain from 1 to 10 carbon atoms, generally formaldehyde or paraformaldehyde. The amine used can be an amine or a polyamine including the alkanolamines having one or more hydroxyl groups. The amines used are generally selected from ethanolamine, diethanolamines, methylamine, dimethylamine, ethylenediamine, dimethylaminopropylamine, diethylenetriamine, triethylenetetramine, tetraethylenepentamine and/or 2-(2-aminoethylamino)ethanol. This dispersant can be prepared by a Mannich reaction by reacting an alkylphenol, an aldehyde and an amine as described in U.S. Pat. No. 5,697,988.

other dispersants, such as:

carboxylic dispersants such as those described in U.S. Pat. No. 3,219,666;

amine dispersants originating from the reaction between halogenated aliphatic hydrocarbon compounds of high molecular weight with polyamines, preferably polyalkylene polyamines, described for example in U.S. Pat. No. 3,565,804;

polymeric dispersants obtained by polymerization of alkyl acrylates or alkyl methacrylates (C8 to C30 alkyl chains), aminoalkyl acrylates or acrylamides and acrylates substituted with poly(oxyethylene) groups. Examples of polymeric dispersants are described for example in U.S. Pat. Nos. 3,329,658 and 3,702,300;

dispersants containing at least one aminotriazole group such as described for example in U.S. Patent Publication No. 2009/0282731 originating from reaction of a dicarboyxlic acid or anhydride substituted with a hydrocarbyl and an amine compound or salt of the (amino)guanidine type;

oligomers of PIBSA and/or of DDSA and of hydrazine monohydrate, such as those described in EP 1,887,074;

oligomers of ethoxylated naphthol and PIBSA, such as those described in EP 1,884,556;

quaternized ester, amide or imide derivatives of PIBSA, such as those described in WO2010/132259;

mixtures of Mannich bases, for example dodecylphenol/ethylenediamine/formaldehyde, and of PIBSI, such as those described in WO2010/097624 and WO2009/040582;

quaternized terpolymers of ethylene, of alkenyl ester(s) and of monomer(s) with at least one ethylenic unsaturation and containing an at least partially quaternized tertiary nitrogen, such as those described in WO2011/134923.

According to another particularly preferred embodiment, the deposit reducer/detergent/dispersant is chosen from substituted succinic acid anhydrides, in particular polyisobutenyl succinic anhydrides, often called PIBSA, in which the polyisobutylene group (also called polyisobutene) has a molecular mass comprised between 140 and 5000, preferably between 500 and 2000 or preferably between 750 and 1250. Another subject of the invention relates to higher-grade (bio)diesel fuels having improved lacquering resistance, additivated with at least 50 ppm m/m of at least one component chosen from deposit reducers, detergents, dispersants and with at least one additive as defined in the present invention.

These problems of wear resistance of low-sulphur (bio) diesel fuels and lacquering resistance of (Bx or biodiesel) fuels are resolved by using at least one additive comprising at least 50% by mass of polyglycerol monoester(s) and/or diester(s), said polyglycerols having from 2 to 5 glycerol units per molecule and the esters being fatty acid derivatives, the fatty acid(s) having optionally one or more ethylenic unsaturations, and the majority, i.e. more than 50% by number of fatty chains comprised between 12 and 24 carbon atoms. The selective conversion of glycerol to polyglycerols (PG) and polyglycerol esters (PGE) is an important reaction leading, as indicated previously, to various biodegradable surfactants that are very widely used in industry. The polyglycerols can be obtained by oligomerization of glycerol. Generally, the reaction is carried out in the presence of homogeneous or heterogeneous acid or basic catalysts.

In general, the polyglycerols are mixtures of close homologues with a majority target molecule. Thus, for example, the diglycerol marketed by the company Fluka has the following distribution with 87% diglycerol and 10% tri- and tetraglycerol.

The synthesis of the fatty acid and polyglycerol mono- and diesters is known per se; they can for example be prepared by esterification of fatty acid(s) and diglycerol in the case of diglycerol mono- and diesters (or triglycerol in the case of triglycerol mono- and diesters). The product originating from this esterification reaction comprises a mixture of polyglycerol mono-, di-; tri- and tetra-esters, (for example diglycerol, triglycerol, mixture of di- and triglycerol), as well as small quantities of fatty acid(s) and polyglycerol, (for example diglycerol, triglycerol, mixture of di- and triglycerol) which have not reacted. By way of example, patent EP 1,679,300 describes a method for the production of fatty acid and polyglycerol esters, in which glycerol is added to a reaction mixture obtained by a direct esterification reaction between polyglycerol and a fatty acid at a temperature ranging from 60° C. to less than 180° C., and the glycerol phase containing unreacted polyglycerols is separated and eliminated.

The fatty acid and polyglycerol esters have been known for a long time as nonionic surfactants; being biodegradable and biocompatible, they are in particular used for foods and body care. U.S. Pat. No. 5,632,785 describes the polyglycerol esters as fuel economy additives for any type of fuel; only the example of decaglycerol tetraoleate is given as a fuel economy additive in a gasoline fuel.

The polyglycerols can be represented by one of the following general formulae:

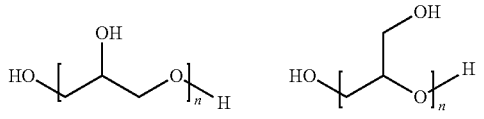

where n≥2, represents the number of glycerol units of the polyglycerol.

The polyglycerols (PG) are characterized by their molecular mass, their number of hydroxyl groups and their hydroxyl index, as stated in the table below.

| polyglycerol | n | Molecular mass | OH number | Hydroxyl index (mg KOH/g) |
|---|---|---|---|---|
| diglycerol | 2 | 166 | 4 | 1352 |
| triglycerol | 3 | 240 | 5 | 1169 |
| tetraglycerol | 4 | 314 | 6 | 1071 |
| pentaglycerol | 5 | 388 | 7 | 1012 |

The fatty acids from which the polyglycerol esters according to the invention originate can be chosen from the stearates, isostearates, oleates, linoleates, linolenates, behenates, arachidonates, ricinoleates, palmitates, myristates, laurates, caprates, and their mixtures and the corresponding esters such as the mixture diglycerylmonostearate (CAS 12694-22-3), polyglyceryl-2 diisostearate, or diglyceryl diisostearate (CAS 67938-21-0), polyglyceryl-2 isostearate (CAS 73296-86-3), polyglyceryl-2 isostearate (CAS 81752-33-2), polyglyceryl-2 oleate (CAS 96499-68-2), diglyceryl monooleate (CAS 49553-76-6), polyglyceryl-2 triisostearate (CAS 120486-24-0), polyglyceryl-3 caprate (CAS 133654-02-1), trig lycerylcaprate (CAS 51033-30-8), polyglyceryl-3 distearate (CAS 94423-19-5), polyglyceryl-3 isostearate (CAS 127512-63-4), polyglyceryl-3 diisostearate (CAS 66082-42-6), polyglyceryl-3 monooleate (CAS 33940-98-6), polyglyceryl-3 dioleate (CAS 79665-94-4), polyglycerol-3 trioleate (CAS 79665-95-5).

The fatty acids can originate from the transesterification or the saponification of vegetable oils and/or animal fats. The preferred vegetable oils and/or animal fats are chosen according to their oleic acid concentration. Reference may be made for example to Table 6.21 of Chapter 6 of the publication Carburants & Moteurs by J. C. Guibet and E. Faure, 2007 edition in which the compositions of several vegetable oils and animal fats are given. The fatty acids can also originate from fatty acids derived from tall oil fatty acid (TOFA) which comprise a majority of fatty acids, typically greater than or equal to 90% by mass as well as resin acids and unsaponifiables in a minority, i.e. in quantities generally less than 10% by mass.

Preferred additives according to the invention capable of improving the wear resistance of low-sulphur (bio)diesel fuels and the lacquering resistance of higher-grade (bio) diesel fuels comprise partial esters of diglycerol or triglycerol with at least 50% by mass of monoesters and/or diester(s) of oleic acid and diglycerol, therefore of diglycerol monooleate(s) (DGMO) and/or of diglycerol dioleate(s) (DGDO). Other preferred additives comprise at least 50% by mass of mono- and/or diester(s) of oleic acid and triglycerol, therefore triglycerol monooleate(s) and/or triglycerol dioleate(s). Other preferred additives comprise at least 50% by mass of mono- and/or diester(s) of oleic acid and diglycerol, and/or of triglycerol. The use of these additives makes it possible to improve the lubricity of the low-sulphur diesel or biodiesel fuels for compression-ignition engines in which they are incorporated. The use of these additives in (bio) diesel fuels makes it possible to reduce the wear rate in the fuel admission or injection system, in particular on the fuel injection pump.

The diesel fuels (liquid fuels for compression-injection engines) comprise middle distillates having a boiling point comprised between 100 and 500° C.; their initial crystallization temperature ICT is often greater than or equal to −20° C., in general comprised between −15° C. and +10° C. These distillates are mixtures of bases that can be selected for example from the distillates obtained by direct distillation of crude hydrocarbons or gasoline, vacuum distillates, hydrotreated distillates, distillates originating from catalytic cracking and/or hydrocracking vacuum distillates, the distillates resulting from ARDS type processes (by atmospheric residue desulphurization) and/or visbreaking. The diesel fuels can also contain light cuts such as the gasolines originating from distillation, catalytic or thermal cracking units, alkylation, isomerization, desulphurization units, steam cracking units.

Moreover, the diesel fuels can contain novel sources of distillates, among which there can be mentioned in particular:

- heavier cuts originating from the cracking and visbreaking processes concentrated in heavy paraffins, comprising more than 18 carbon atoms,
- synthetic distillates originating from gas conversion such as those originating from the Fischer Tropsch process,
- synthetic distillates resulting from the processing of biomass of vegetable and/or animal origin, such as in particular NexBTL, alone or in a mixture. The vegetable or animal biomass and the vegetable or animal oils can be hydrotreated or hydrodeoxygenated, coker diesels, alcohols, such as methanol, ethanol, butanols, ethers, (MTBE, ETBE, etc) in general used in mixture with the gasoline fuels, but sometimes with heavier diesel fuels, vegetable and/or animal oils and/or their esters, such as methyl or ethyl esters of vegetable oils or of fatty acids (VOME, VOEE, FAME), hydrotreated and/or hydrocracked and/or hydrodeoxygenated (HDO) vegetable and/or animal oils, and/or also biodiesels of animal and/or vegetable origin.

These novel fuel and heating fuel oil bases can be used alone or in a mixture with conventional petroleum middle distillates as fuel base(s), they generally comprise paraffin long chains greater than or equal to 10 carbon atoms, preferably from C14 to C30.

Within the framework of the present invention, the diesel fuels have a sulphur content less than or equal to 500 ppm by mass, advantageously less than or equal to 100 ppm by mass, and capable of being reduced to a content less than or equal to 50 ppm by mass, or even less than or equal to 10 ppm by mass (this is the case of current diesel fuels for vehicles for which the sulphur content according to European standard EN 590 currently in force must be less than or equal to 10 ppm by mass). The wear resistance and of lacquering resistance additives for diesel fuels according to the invention can be incorporated into the fuels at a value up to 10% by mass, and advantageously so that the concentration in mono- and di-ester(s) of diglycerol and/or of triglycerol in the final fuel is comprised between 20 and 1000 ppm by mass, and preferably between 30 and 200 ppm by mass m/m, i.e. ppm by mass in relation to the total mass of the fuel to which additives are added. According to an embodiment, the higher-grade (bio)diesel fuel compositions contain at least 50 ppm by mass of at least one component chosen from deposit reducers, detergents, dispersants and contain at least one additive according to the invention and optionally at least one or more other functional additives. A person skilled in the art will easily adapt the level of the addition of additives according to the invention as a function of any dilution of the additive in a solvent, the possible presence of other components originating for example from the esterification reaction and/or other functional additives incorporated in the final fuel.

Another subject of the present invention relates to additive packages for (bio)diesel fuel containing at least one additive according to the present invention and at least one or more functional additives. According to an embodiment, the additive packages comprises moreover at least 50 ppm by mass of at least one component chosen from deposit reducers, detergents, dispersants such as those described above. The anti-wear and anti-lacquering additives of the present invention can be used alone or in a mixture with other functional additives, such as deposit reducers/dispersants, anti-oxidants, combustion improvers, corrosion inhibitors, low temperature resistance additives (improving the cloud point, sedimentation rate, filterability and/or low temperature flow), colorants, desemulsifiers, metal deactivators, anti-foaming agents, agents improving the cetane number, co-solvents, compatibilizing agents, anti-wear additives other than those of the present invention, etc.

The other functional additive(s) can be chosen non-limitatively from:

combustion-improving additives; for diesel fuels, there can be mentioned cetane booster additives, in particular (but non-limitatively chosen from alkyl nitrates, preferably 2-ethyl hexyl nitrate, aryl peroxides, preferably benzyl peroxide, and alkyl peroxides, preferably di tert-butyl peroxide; for fuels of the gasoline type, there can be mentioned octane number improver additives; for fuel oils such as domestic heating oil, heavy fuel oil, marine diesel oil, there can be mentioned methyl cyclopentadienyl manganese tricarbonyl (MMT);

anti-oxidant additives, such as aliphatic, aromatic amines, hindered phenols, such as BHT, BHQ;

desemulsifiers or demulsifiers;

anti-static or conductivity improver additives;

colorants;

anti-foaming additives, in particular (but non-limitatively) chosen for example from polysiloxanes, oxyalkylated polysiloxanes, and fatty acid amides originating from vegetable or animal oils; examples of such additives are given in EP 861 182, EP 663 000, EP 736 590;

anti-corrosion additives such as ammonium salts of carboxylic acids;

chelating agents and/or metal sequestering agents, such as triazoles, disalicylidene alkylene diamines, and in particular N,N' bis (salicylidene)propane diamine;

low temperature resistance additives and in particular additives for improving the cloud point, in particular, (but non-limitatively) chosen from the group consisting of long-chain olefin/(meth)acrylic ester/maleimide terpolymers, and the polymers of fumaric/maleic acid esters. Examples of such additives are given in EP 71 513, EP 100 248, FR 2 528 051, FR 2 528 423, EP1 12 195, EP 1 727 58, EP 271 385, EP 291367; anti-sedimentation and/or dispersant additives for paraffins in particular (but non-limitatively) chosen from the group constituted by the (meth)acrylic acid/alkyl (meth)acrylate copolymers amidified by a polyamine, polyamine alkenylsuccinimides, phthalamic acid and double-chain fatty amine derivatives; alkyl phenol/aldehyde resins; examples of such additives are given in EP 261 959, EP 593 331, EP 674 689, EP 327 423, EP 512 889, EP 832 172; U.S. Patent Publication No. 2005/0223631; U.S. Pat. No. 5,998,530; WO 93/14178; multi-functional low temperature operation additives chosen in particular from the group constituted by olefin- and alkenyl nitrate-based polymers such as those described in EP 573 490;

other additives improving the low temperature resistance and the filterability (CFI), such as EVA and/or EVP copolymers;

metal passivators, such as triazoles, alkylated benzotriazoles;

acidity neutralizers such as cyclic alkylamines;

markers, in particular the markers mandated by regulations, for example the colorants specific to each type of fuel or heating fuel oil.

fragrancing agents or agents for masking odours, such as those described in EP 1 591 514;

lubricity additives, anti-wear agents and/or friction modifiers other than those described above, in particular (but non-limitatively) chosen from the group constituted by fatty acids and their ester or amide derivatives, in particular glycerol monooleate, and derivatives of mono- and polycyclic carboxylic acids; examples of such additives are given in the following documents: EP 680 506, EP 860 494, WO 98/04656, EP 915 944, FR2 772 783, FR 2 772 784.

Another subject of the present invention relates to higher-grade (bio)diesel fuel compositions containing at least one additive as defined in any one of claims 1 to 4 and at least 50 ppm by mass of at least one component chosen from deposit reducers, detergents, dispersants as described above. According to another particularly preferred embodiment, the deposit reducer/detergents/dispersants are chosen from substituted succinic acid anhydrides, in particular polyisobutenyl succinic anhydrides, often called PIBSA, in which the polyisobutylene group (also called polyisobutene) has a molecular mass comprised between 140 and 5000 and preferably between 500 and 2000 or preferably between 750 and 1250. The optional other additives are generally incorporated in quantities in the range from 50 to 1500 ppm w/w, i.e. ppmw relative to the total weight of the additivated fuel.

These additives can be incorporated into the fuels following any known method; by way of example, the additive or the mixture of additives can be incorporated in concentrate form comprising the additive(s) and a solvent, compatible with the (bio) diesel fuel, the additive being dispersed or dissolved in the solvent. Such concentrates in general contain from 20 to 95% by mass of solvents.

The solvents are organic solvents which generally contain hydrocarbon solvents. By way of example of solvents, there can be mentioned petroleum fractions, such as naphtha, kerosene, heating oil; aromatic hydrocarbons that are aliphatic and/or aromatic such as hexane, pentane, decane, pentadecane, toluene, xylene, and/or ethylbenzene and alkoxyalkanols such as 2-butoxyethanol and/or mixtures of hydrocarbons such as mixtures of commercial solvents such as for example Solvarex 10, Solvarex LN, Solvent Naphtha, Shellsol AB, Shellsol D, Solvesso 150, Solvesso 150 ND, Solvesso 200, Exxsol, ISOPAR and optionally polar dissolution adjuvants, such as 2-ethylhexanol, decanol, isodecanol and/or isotridecanol.

The invention relates to the use of at least one additive composition according to the invention incorporated in a higher-grade diesel or biodiesel for improving the lacquering resistance, i.e. fouling on the head and/or on the body of the needles of the fuel injection system but also in the whole needle lift control system (valves) of the injection system, in particular for engines equipped with fuel injection systems of the Euro 4 to Euro 6 type. The invention also relates to a method for improving the lacquering resistance comprising the introduction of additives into a higher-grade (bio)diesel fuel, said additives comprising at least 50% by mass of polyglycerol monoester(s) and/or diester(s), said polyglycerols having from 2 to 5 glycerol units per molecule and the ester units being fatty acid derivatives, the fatty acid(s) optionally having one or more ethylenic unsaturations, and more than 50% by number of fatty chains comprising between 12 and 24 carbon atoms.

Preferably, the method for improving lacquering resistance according to the invention has the following features:

- higher-grade (bio)diesel fuels have a sulphur content less than or equal to 500 ppm,
- the additives comprise partial esters of diglycerol and/or of triglycerol,
- the partial diglycerol and/or triglycerol esters comprise either at least 50% by mass of monoester(s) and/or diester(s) of oleic acid and diglycerol, therefore diglycerol monooleate(s) (DGMO) and/or diglycerol dioleate (s) (DGDO) or at least 50% by mass of mono- and/or diester(s) of oleic acid and triglycerol, or at least 50% by mass of mono- and/or diester(s) of oleic acid and diglycerol and/or triglycerol,
- the additives comprise moreover other functional additives, such as deposit reducers/dispersants, anti-oxidants, combustion improvers, corrosion inhibitors, low temperature resistance additives (improving the initial crystallization temperature, sedimentation rate, filterability and/or low temperature flow), colorants, desemulsifiers, metal deactivators, anti-foaming agents, agents improving the cetane number, co-solvents, compatibilizing agents, other lubricity agents, anti-wear agents and/or friction modifiers and optionally one or more solvents.

According to a particular embodiment, the method for the improvement of the lacquering resistance according to the invention also makes it possible to improve the wear resistance, in particular of the injectors, and the lubricity of (bio)diesel fuels having a sulphur content less than or equal to 500 ppm by mass. The method of improving lacquering resistance according to the invention makes it possible to avoid and/or reduce and/or delay:

- a slowing of the response of the fuel injector,
- sticking of internal components, which can lead to a loss of control of injection time as well as of the amount of fuel supplied per injection,
- a loss of manoeuvrability of the vehicle,
- variations in power,
- an increase in fuel consumption,
- an increase in pollutants,
- a disturbance in combustion, since the amount of fuel injected will not be that envisaged theoretically and the injection profile will be different,
- an unstable idle of the vehicle,
- an increase in engine noise,
- a lowering of the quality of combustion over the long term,
- a lowering of the quality of atomization.

The inventors have also developed a novel method that is reliable and robust for evaluating the sensitivity of (bio) diesel fuels, in particular those of higher grade, to lacquering. This method, in contrast to the methods described in the publications cited above, is not a laboratory method but is based on real engine tests and is therefore of industrial interest and makes it possible to quantify the effectiveness of the additives or of the additive compositions against lacquering. The method of measuring lacquering developed by the inventors is detailed below:

- The engine used is a four-cylinder, 16-valve, high-pressure injection common rail diesel engine with a cylinder capacity of 1500 $cm^3$ and a power of 80 hp: regulation of the fuel injection pressure takes place in the high-pressure part of the pump.
- The power point is 40 h at 4000 rpm; the position of the injector in the chamber has been lowered by 1 mm relative to its nominal position, which on the one hand promotes the release of thermal energy from combustion, and on the other hand brings the injector closer to the combustion chamber.
- The flow rate of fuel injected is adjusted so as to obtain an exhaust temperature of 750° C. at the start of the test.
- The injection advance was increased by 1.5° crankshaft relative to the nominal setting (changing from +12.5° to +14° crankshaft) still with the aim of increasing thermal stresses to which the injector nozzle is subjected.
- Finally, to increase the stresses to which the fuel is subjected, the injection pressure was increased by 10 MPa relative to the nominal pressure (i.e. changing from 140 MPa to 150 MPa) and the temperature is set at 65° C. at the inlet of the high-pressure pump.

The technology used for the injectors requires high fuel return, which promotes degradation of the fuel since it can be subjected to several cycles in the high-pressure pump and the common rail before being injected into the combustion chamber.

A variant of the method for testing the clean-up effect (i.e. cleaning the type 1 and/or type 2 deposits) has also been developed. It is based on the preceding method but is separated into two 20-hour periods:

For the first 20 hours a higher-grade diesel B7 is used (containing a detergent of the PIBSA type and an acid friction modifier) known for its tendency to cause lacquering. After 20 hours, two of the four injectors are dismantled and assessed in order to verify the quantity of deposits present and then replaced by two new injectors.

For the last 20 hours of the test, the product to be assessed is used. At the end of the test (40 hours in total), the injectors are dismantled and assessed.

At the end of the test, three sets of two injectors are available:

Set 1: 2 injectors having undergone 20 hours of higher-grade fuel known for its tendency to cause lacquering.

Set 2: 2 injectors having undergone 20 hours of higher-grade fuel known for its tendency to produce lacquering+20 hours of product to be assessed.

Set 3: 2 injectors having undergone 20 hours of product to be assessed.

Expression of the Results:

In order to ensure the validity of the result, various parameters are monitored during the test: power, torque and fuel consumption indicate whether the injector is fouled or whether its operation is deteriorated through formation of deposits, since the operating point is the same throughout the test. The characteristic temperatures of the various fluids (cooling liquid, fuel, oil) allow the validity of the tests to be monitored. The fuel is adjusted to 65° C. at the pump inlet, and the cooling liquid is adjusted to 90° C. at the engine outlet. The smoke values allow the combustion timing to be monitored at the start of the test (target value 3FSN) and ensure that it is properly repeatable from one test to the next.

The injectors are dismantled at the end of the test in order to inspect and assess the deposits formed along the needles. The scoring procedure adopted for assessing the needles is as follows:

The scale of scores varies from −2.5 (for a heavy deposit) to 10 (for a new needle without any deposit). The final score is a weighted average of the scores for all the needle surfaces assessed.

Total surface area: cylindrical portion (immediately after the conical portion)+conical portion: 100%, including surface area weighting for the cylindrical portion (immediately after the conical portion): 68% and surface area weighting for the conical portion: 32%; see FIG. 1 attached (the percentages indicated correspond to one quarter of the surface area of the needles: the overall surface area weighting is therefore 17×4=68%)

A product performance threshold was determined with respect to this evaluation procedure: Result <4=Poor, result >4=Satisfactory.

The following examples illustrate the invention without limiting it.

EXAMPLE 1

Preparation of Anti-wear and Anti-lacquering Additives According to the Invention In the presence of a catalyst of the MeONa type, 90 g of diglycerol is reacted at 170° C. with 500 g of oleic sunflower oil (concentration in oleic acid equivalent under reduced pressure of 300 mbars (0.03 MPa)) for 6 hours. The operating procedure above is repeated for a $2^{nd}$ time for preparing a $2^{nd}$ product sample. The composition by mass of the products obtained measured by gel permeation chromatography is shown in Table 1 below.

TABLE 1

| Component | DGMO 1 | DGMO 2 |
|---|---|---|
| Diglycerol monoester | 24.7 | 31.4 |
| Diglycerol diester | 41.2 | 30.2 |
| Diglycerol triester/triglycerides | 18.6 | 14.4 |
| Diglycerol tetraester | 6.6 | 6.4 |
| Monoglyceride | 2.4 | nd |
| Diglyceride | 1 | 2.1 |
| Diglycerol | nd | 3.3 |
| Oleic sunflower methyl ester | 5.3 | 6.4 |

nd = not determined

EXAMPLE 2

Measurement of Wear Resistance (HFRR Rig)

One of the additives according to the invention prepared in Example 1 is incorporated into a diesel fuel and the lubricity of the additivated fuel is measured according to the HFRR method described in standard ASTM 12156-1. The diesel fuel used in this example is a B0 fuel that is "biofree" and devoid of lubricant additive, containing less than 10 ppm/m sulphur the aromatic character of which is not very strong (22% m/m) and the apparent density is relatively low (821.9 g/L).

By way of comparison, the same fuel is additivated on one hand with an additive constituted essentially of glycerol monooleate (PC 60) and on the other hand with a TOFA, as described in EP 915 944. The detail of each fuel composition tested, as well as the average wear diameter obtained with the HFRR rig are summarized in Table 2.

TABLE 2

| | Test N° | | | | |
|---|---|---|---|---|---|
| Additive added | 2-1 0 | 2-2 (comparative) glycerol monooleate (MGMO) | 2-3 (comparative) TOFA | 2-4 DGMO 1 | 2-5 DGMO 2 |
| @ 0 ppm (m/m) | 680 μm | 680 μm | 680 μm | 680 μm | 680 μm |
| @200 ppm (m/m) | — | 298 μm | 362 μm | 279 μm | 281 μm |
| @500 ppm (m/m) | — | 198 μm | 320 μm | 192 μm | 171 μm |
| @10000 ppm (m/m) | — | 176 μm | 199 μm | 207 μm | 168 μm |

EXAMPLE 3

Measurement of Wear Resistance (HFRR Rig)

In a "biofree" B0 diesel devoid of lubricant additive, containing less than 10 ppm/m sulphur and, aromatic character of which is not very strong (22% m/m) having a relatively low apparent density (821.9 g/L), either a single lubricant additive (DGMO, MGMO or TOFA) is incorporated, or a mixture of at least 2 lubricant additives including one of the DGMO additives according to the invention of Example 1 and at least one known lubricant additive (TOFA) and/or glycerol monooleate on the other hand. The lubricity of the product is measured according to the HFRR method described in ASTM 12156-1. A. The detail of each fuel composition tested, as well as the average wear diameter obtained with the HFRR rig and the coefficient of friction are shown in Table 3 below.

TABLE 3

| Additive(s) added (ppm m/m) | None | DGMO (200) | TOFA (200) | MGMO (200) | DGMO (150) + TOFA (50) | DGMO (100) + TOFA (100) | DGMO (50) + TOFA (150) |
|---|---|---|---|---|---|---|---|
| Wear diameter (μm) | 595 | 281 | 401 | 298 | 246 | 325 | 349 |
| Coefficient of friction | 0.595 | 0.161 | 0.185 | 0.181 | 0.173 | 0.178 | 0.182 |

| Additive(s) added (ppm m/m) | DGMO (150) + MGMO (50) | DGMO (100) + MGMO (100) | DGMO (50) + MGMO (150) | TOFA (150) + MGMO (50) | TOFA (100) + MGMO (100) | TOFA (50) + MGMO (150) | DGMO (67) + TOFA (67) + MGMO (67) |
|---|---|---|---|---|---|---|---|
| Wear diameter (μm) | 265 | 305 | 280 | 376 | 306 | 308 | 273 |
| Coefficient of friction | 0.18 | 0.179 | 0.192 | 0.187 | 0.179 | 0.174 | 0.174 |

EXAMPLE 4

Measurements of Lacquering Resistance

According to the procedure for measuring the lacquering resistance described above, the performance is assessed of several additive packages introduced into a diesel matrix representative of the French market (B7=diesel produced in France containing 7% FAME (fatty acid methyl ester) and complying with EN 590). The detail of each fuel composition tested, as well as the results obtained, are shown in Table 4. Tests G, G' and G" correspond to the same test following the procedure for measuring the lacquering resistance, clean-up version. The result G corresponds to Set 1 injectors, G' to Set 2 injectors, G" to Set 3 injectors according to the description given above. The quantities shown in Table 4 are quantities by mass (m/m).

TABLE 4

| Test N° | A | B | C | D | E | F | G | G' | G" |
|---|---|---|---|---|---|---|---|---|---|
| Fuel | B7 | B7 | B7 | B7 | B7 | B7 | B7 | B7 | B7 |
| PIBSA type diesel detergent | — | 330 ppm | 330 ppm | 330 ppm | 170 ppm | 170 ppm | 330 ppm | 330 then 170 ppm | 170 ppm |
| TOFA | — | 200 ppm | — | — | 200 ppm | — | 200 ppm | 200 then 0 ppm | — |
| MGMO | — | — | 200 ppm | — | — | — | — | — | — |
| DGMO | — | — | — | 200 ppm | — | 200 ppm | — | 0 then 200 ppm | 200 ppm |
| Type 1 deposits score | 8.7 | −1 | 1.7 | 9.0 | 5.0 | 8.0 | 1.9 | 7.9 | 8.0 |
| Type 2 deposits score | 7.1 | −1 | 6.3 | 7.9 | 2.8 | 7.2 | 2.5 | 6.4 | 5.6 |
| Overall score | 8.2 | −1 | 3.2 | 8.7 | 2.8 | 7.8 | 2.1 | 7.9 | 7.3 |

The invention claimed is:

1. A method for improving the lacquering resistance of higher-grade diesel or biodiesel fuels comprising a step of adding additives, the additives comprising at least 50% by mass of polyglycerol monoester(s) and/or diester(s), the polyglycerols having from 2 to 5 glycerol units per molecule and the ester units being fatty acid derivatives, and more than 50% by number of fatty chains comprising between 12 and 24 carbon atoms, wherein the additives act in order to improve the lacquering resistance of said diesel or biodiesel fuels, and wherein the diesel or biodiesel fuels comprise at least one acid friction modifier.

2. The method according to claim 1, wherein the higher-grade diesel or biodiesel fuels have a sulphur content less than or equal to 500 ppm by mass.

3. The method according to claim 1, wherein the additives comprise partial esters of diglycerol and/or triglycerol.

4. The method according to claim 3, wherein the partial esters of diglycerol and/or triglycerol comprise either at least 50% by mass of monoester(s) and/or diester(s) of oleic acid and diglycerol, therefore of diglycerol mono-oleate(s)

(DGMO) and/or diglycerol dioleate(s) (DGDO) or at least 50% by mass of mono- and/or diester(s) of oleic acid and triglycerol, or at least 50% by mass of mono- and/or diester(s) of oleic acid and diglycerol and/or triglycerol.

5. The method according to claim 1, wherein the additives further comprise one or more other functional additives.

6. The method according to claim 1, wherein the higher-grade diesel or biodiesel fuels comprise at least 50 ppm of at least one component chosen from deposit reducers, detergents, dispersants chosen from:

substituted succinic acid anhydrides, substituted amines, polyisobutenesuccinimides of formula

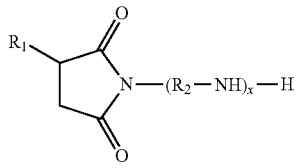

where R represents a polyisobutene group of molecular weight comprised between 140 and 5000; or their bissuccinimide, succinnamic, succinamide structural equivalents, and where R2 represents at least one of the following segments —CH2-CH2-, CH2-CH2-CH2, —CH2-CH(CH3)- and x represents an integer comprised between 1 and 6, polyethylenamines, polyether amines of formula:

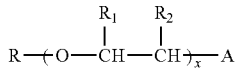

where R is an alkyl or aryl group having from 1 to 30 carbon atoms; R1 and R2 are each independently a hydrogen atom, an alkyl chain with 1 to 6 carbon atoms or —O—CHR1-CHR2-; A is an amine or N-alkylamine with 1 to 20 carbon atoms in the alkyl chain, an N,N-dialkylamine having from 1 to 20 carbon atoms in each alkyl group, or a polyamine with 2 to 12 nitrogen atoms and from 2 to 40 carbon atoms and x is in the range from 5 to 30, the products of reaction between a phenol substituted with a hydrocarbon chain, an aldehyde and an amine or polyamine or ammonia, carboxylic dispersants, amine dispersants resulting from the reaction between halogenated aliphatic hydrocarbon compounds of high molecular weight with polyamines, polymeric dispersants obtained by polymerization of alkyl acrylates or alkyl methacrylates having C8 to C30 alkyl chains, aminoalkyl acrylates or acrylamides and acrylates substituted with poly(oxyethylene) groups, dispersants containing at least one aminotriazole group, oligomers of PIBSA and/or of dodecenyl succinic anhydride (DDSA) and of hydrazine monohydrate, oligomers of ethoxylated naphthol and of PIBSA, quaternized ester, amide or imide derivatives of PIBSA, mixtures of Mannich bases, and of PIBSI, quaternized terpolymers of ethylene, of alkenyl ester(s) and of monomer(s) with at least one ethylenic unsaturation and containing an at least partially quaternized tertiary nitrogen.

7. The method according to claim 6, wherein the deposit reducer(s)/detergent(s)/dispersant(s) are chosen from substituted succinic acid anhydrides.

8. The method according to claim 1, further comprising improving wear resistance and lubricity of diesel or biodiesel fuels having a sulphur content less than or equal to 500 ppm by mass, the method further comprising a step of adding the additive as defined in claim 1.

9. A composition of diesel or biodiesel fuel comprising a sulphur content less than or equal to 500 ppm by mass, containing at least one additive comprising at least 50% by mass of polyglycerol monoester(s) and diester(s), the polyglycerols having from 2 to 5 glycerol units per molecule and the ester units being fatty acid derivatives, and more than 50% by number of fatty chains comprising between 12 and 24 carbon atoms, and at least one acid friction modifier.

10. The composition of diesel or biodiesel fuel according to claim 9 containing up to 10% by mass of one or more of the additives.

11. Compositions of higher-grade diesel or biodiesel fuel, containing at least one additive comprising at least 50% by mass of polyglycerol monoester(s) and/or diester(s), the polyglycerols having from 2 to 5 glycerol units per molecule and the ester units being fatty acid derivatives, and more than 50% by number of fatty chains comprising between 12 and 24 carbon, at least one acid friction modifier and at least 50 ppm by mass of at least one component chosen from: deposit reducers, detergents, dispersants, chosen from:

substituted succinic acid anhydrides, substituted amines, polyisobutenesuccinimides of formula:

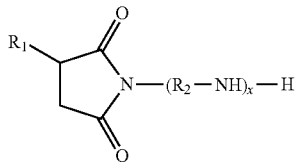

where R represents a polyisobutene group of molecular weight comprised between 140 and 5000; or their bissuccinimide, succinnamic, succinamide structural equivalents, and where R2 represents at least one of the following segments —CH2-CH2-, CH2-CH2-CH2, —CH2-CH(CH3)- and x represents an integer between 1 and 6, polyethyleneamines, polyetheramines of formula:

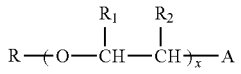

where R is an alkyl or aryl group having from 1 to 30 carbon atoms; R1 and R2 are each independently a hydrogen atom, an alkyl chain with 1 to 6 carbon atoms or —O—CHR1-CHR2-; A is an amine or N-alkylamine with 1 to 20 carbon atoms in the alkyl chain, an N,N-dialkylamine having from 1 to 20 carbon atoms in each alkyl group, or a polyamine with 2 to 12 nitrogen atoms and from 2 to 40 carbon atoms and x is in the range from 5 to 30, the products of reaction between a phenol substituted with a hydrocarbon chain, an aldehyde and an amine or polyamine or ammonia, carboxylic dispersants, amine dispersants resulting from the reaction between halogenated aliphatic hydrocarbon compounds of high molecular weight with polyamines, polymeric disperants obtained by polymerization of alkyl acrylates or alkyl methacrylates having C8 to C30 alkyl chains, aminoalkyl acrylates or acrylamides and acrylates substituted with poly(oxyethylene) groups, disperants containing at least one aminotriazole group, oligomers of PIBSA and/or of dodecenyl succinic anhydride DDSA and of hydrazine monohydrate, oligomers of ethoxylated naphthol and of PIBSA, quaternized ester, amide or imide derivatives of PIBSA, mixtures of Mannich bases and of PIBSI, quaternized terpolymers of ethylene, of alkenyl ester(s) and of monomer(s) with at least one ethylenic unsaturation and containing an at least partially quaternized tertiary nitrogen.

12. The compositions of diesel or biodiesel fuel according to claim 11, wherein the deposit reducer(s)/detergent(s)/dispersant(s) are chosen from substituted succinic acid anhydrides.

13. The compositions of diesel or biodiesel fuel according to claim 9 having a concentration in mono- and di-ester(s) of diglycerol and/or of triglycerol comprised between 20 and 1000 ppm by mass m/m.

14. The method according to claim 5, wherein the other functional additives are chosen from deposit reducers/dispersants, anti-oxidants, combustion improvers, corrosion inhibitors, low temperature resistance additives (improving the cloud point, sedimentation rate, filterability and/or low temperature flow), colorants, de-emulsifiers, metal deactivators, anti-foaming agents, agents improving the cetane number, co-solvents, compatibilizing agents, lubricant additives different from the additives defined in claim 1, anti-wear agents and/or friction modifiers different from the friction modifier defined in claim 1.

15. The method according to claim 7, wherein the substituted succinic acid anhydrides are chosen from polyisobutenyl succinic anhydrides (PIBSA), in which the polyisobutylene group has a molecular mass comprised between 140 and 5000.

16. The method according to claim 8, for improving the wear resistance of the injectors.

17. The compositions of diesel or biodiesel fuel according to claim 9, further comprising one or more other functional additives chosen from deposit reducers/dispersants, anti-oxidants, combustion improvers, corrosion inhibitors, low temperature resistance additives (improving the cloud point, sedimentation rate, filterability and/or low temperature flow), colorants, desemulsifiers, metal deactivators, anti-foaming agents, agents improving the cetane number, co-solvents, compatibilizing agents, lubricant additives different from the additives defined in claim 1, anti-wear agents and/or friction modifiers different from the friction modifier defined in claim 1.

18. The compositions of diesel or biodiesel fuel according to claim 12, wherein the substituted succinc acid anhydrides are chosen from polyisobuteny succinic anhydrides (PIBSA), in which the polyisobutylene group has a molecular mass comprised between 140 and 5000.

19. The compositions according to claim 9, wherein the friction modifier is selected from tall oil fatty acid (TOFA).

20. The compositions according to claim 9, wherein the friction modifier(s) are present in an amount ranging from 50 to 1500 ppm by weight of the fuels.

* * * * *